United States Patent [19]

Bjelvert

[11] 3,991,678

[45] Nov. 16, 1976

[54] MAGNETIC LAND MINE DEVICE

[75] Inventor: Sven William Bjelvert, Eskilstuna, Sweden

[73] Assignee: Forenade Fabriksverken, Eskilstuna, Sweden

[22] Filed: Mar. 31, 1975

[21] Appl. No.: 563,512

[30] Foreign Application Priority Data

Mar. 29, 1974 Sweden ..... 7404243

[52] U.S. Cl. ..... 102/19.2; 102/70.2 GA

[51] Int. Cl.[2] ..... F42B 23/26

[58] Field of Search..... 102/8, 16, 19.2, 70.2 GA; 310/10

[56] References Cited

FOREIGN PATENTS OR APPLICATIONS 2,160,294 6/1973 Germany..... 102/70.2 GA

*Primary Examiner*—Verlin R. Pendegrass

*Attorney, Agent, or Firm*—Fleit & Jacobson

[57] ABSTRACT

A device capable of detonating a magnetic land mine at the removal of same from the ground, comprising a magnetic field sensing device, an annular tube located in the vicinity of the magnetic field sensing device, and a magnetized ball movably housed in the tube.

4 Claims, 6 Drawing Figures

MAGNETIC LAND MINE DEVICE

The present invention relates to a land mine of a magnetic type. Such a mine comprises a device in the form of a coil, which device senses the magnetic field and is connected to a mine detonating means. If a tank passes above the mine, an electric voltage is induced in the coil because of the permanent magnetism in the tank and/or because of the change in the geomagnetism caused by the tank.

The device according to the invention will bring about detonation, when the enemy picks up the mine placed in the ground. The device is characterized by an annular tube comprising a movable, magnetized ball, the tube being arranged in the vicinity of or round the magnetic field sensing device.

The device according to the invention will be described in more detail with reference to FIGS. 1–6 of the accompanying drawings.

Figure 1:
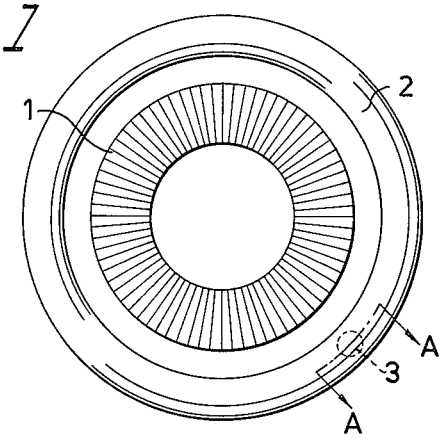
FIG. 1 is a horizontal sectional view.
Figure 2:
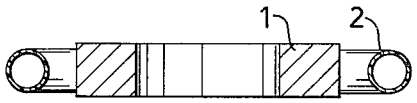
FIG. 2 is a vertical sectional view through the parts of the mine that are relevant in this connection.
Figure 3:
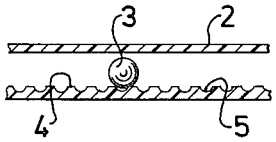
FIG. 3 is a sectional view along the line A—A of FIG. 1.

The land mine comprises a magnetic field sensing device in the form of a coil 1, connected to a means for the detonation of the mine. An annular tube 2, circular in cross-section, of a non-magnetic material, e.g. plastic, is arranged around the coil. The tube comprises a movable, magnetized steel ball 3. If an enemy tries to pick up the mine placed in the ground, this cannot be done while maintaining an exactly horizontal position of the mine, and so the ball will start rolling inside the tube. The north pole and the south pole of the ball will rotate around the centre of the ball, inducing a voltage in the coil with the detonation of the mine as the result. In order that the ball will not start rolling at small vibrations, the bottom surface of the tube is, according to FIG. 3, provided with ridges 4 and grooves 5 transverse relatively to the central axis of the tube.

Figure 4:
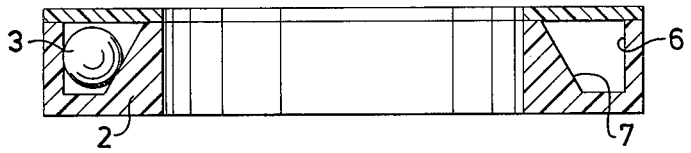
FIG. 4 is a vertical sectional view through another embodiment of the tube.

Another arrangement to prevent the ball from starting to roll at small vibrations is shown in FIG. 4. The annular tube is here provided with a horizontal bottom surface and a plane, vertical side surface 6 and a plane, inclined side surface 7. Optionally both side surfaces may be inclined. The distance between the side surfaces decreases in the downward direction. The diameter of the ball is so adapted that the ball is in contact only with the side surfaces of the tube, i.e. the ball is resting on the side surfaces. Consequently, a certain inertia against rolling at small vibrations is obtained because of the friction against the side surfaces.

Figure 5:
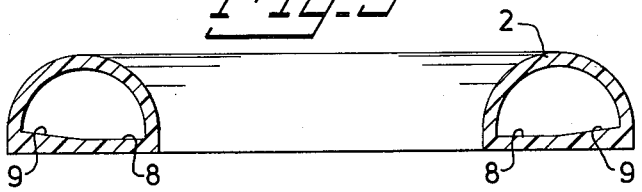
FIGS. 5 and 6 are vertical sectional views through another embodiment of the tube.
Figure 6:
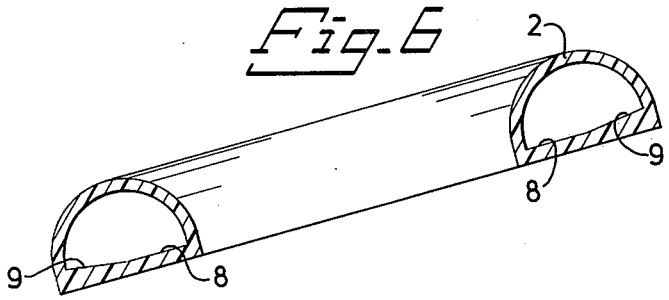

An arrangement to facilitate the ball starting to roll, when the mine is inclined, is shown in FIGS. 5 and 6. The bottom surface of the annular tube does here consists of two parts, an inner, normally horizontal part 8 provided with ridges and grooves, transverse relatively to the central axis of the tube, and an outer, plane, smooth part 9 that inclines somewhat downwards towards the inner part. In the normal horizontal position (FIG. 5) the ball is resting against the inner part provided with ridges and grooves. Upon attempt to pick up the mine it takes an inclined position (FIG. 6) causing the ball to rest on the outer smooth part, where it easily will begin to roll.

With the use in accordance with the invention of a magnetized ball inside a tube to achieve the detonation of a magnetic land mine, when the mine is picked up by the enemy, a simple device is accomplished that does not comprise any extra electric connections and switches and that is not influenced by moisture and soil because of the closed construction thereof.

What is claimed is:

1. A device capable of detonating a magnetic land mine upon removal of same from the ground, comprising, in combination, a stationary magnetic field sensing device, a stationary annular tube located substantially in a horizontal plane in the vicinity of said magnetic field sensing device, a magnetized ball disposed in said tube for rolling movement therein upon the tilting of said tube out of said horizontal plane to operatively condition said sensing device, means in said tube engageable by said ball for retaining said ball against said rolling movement when said tube is subjected to vibrations of a limited magnitude.

2. A device as defined in claim 1 wherein said tube is circular in cross-section and wherein said ball retaining means comprises a plurality of alternating ridges and grooves on the lower portion of said tube in cross-section extending transversely relative to an axis running through the center of the circular cross-section of the tube.

3. A device as defined in claim 1 wherein said tube in cross-section includes two angularly disposed, plane side surfaces, the distances therebetween decreasing downwardly, said ball having a diameter such that said ball abuts only said side surfaces.

4. A device as defined in claim 1 wherein said tube in cross-section includes an inner, normally horizontal portion provided with alternating ridges and grooves extending transversely relative to an axis running through the center of the cross-section of the tube and an inner, plane, smooth portion disposed angularly downward towards said inner portion.

* * * * *